US006668566B2

(12) United States Patent
Brun et al.

(10) Patent No.: US 6,668,566 B2
(45) Date of Patent: Dec. 30, 2003

(54) SYSTEM AND A METHOD OF AUTOMATIC DEFROST FOR A REFRIGERATION APPLIANCE

(75) Inventors: Roberto de Medeiros Brun, Joinville (BR); Marco Eduardo Marques, Joinville (BR)

(73) Assignee: Multibras S.A. Eletrodomesticos, Sao Paulo (BR)

( * ) Notice: Subject to any disclaimer, the term of this patent is extended or adjusted under 35 U.S.C. 154(b) by 0 days.

(21) Appl. No.: 10/148,092

(22) PCT Filed: Dec. 1, 2000

(86) PCT No.: PCT/BR00/00132

§ 371 (c)(1),
(2), (4) Date: Sep. 27, 2002

(87) PCT Pub. No.: WO01/44732

PCT Pub. Date: Jun. 21, 2001

(65) Prior Publication Data

US 2003/0074907 A1 Apr. 24, 2003

(30) Foreign Application Priority Data

Dec. 13, 1999 (BR) ..... 9906192

(51) Int. Cl.[7] ..... F25P 21/00
(52) U.S. Cl. ..... 62/154; 62/155; 62/156
(58) Field of Search ..... 62/151, 154, 155, 62/156, 157, 158, 234, 128

(56) References Cited

U.S. PATENT DOCUMENTS

| | | | | |
|---|---|---|---|---|
| 4,056,948 A | | 11/1977 | Goodhouse | 62/155 |
| 4,344,294 A | | 8/1982 | Gelbard | 62/155 |
| 5,228,300 A | | 7/1993 | Shim | 62/80 |
| 5,564,286 A | | 10/1996 | Suse | 62/153 |
| 5,765,382 A | * | 6/1998 | Manning et al. | 62/154 |
| 5,816,054 A | * | 10/1998 | Yoo et al. | 62/80 |
| 5,927,083 A | | 7/1999 | Guo et al. | 62/80 |

* cited by examiner

*Primary Examiner*—Harry B. Tanner
(74) *Attorney, Agent, or Firm*—Darby & Darby

(57) ABSTRACT

A system and a method of automatic defrost for a refrigeration appliance, including a hermetic compressor driven by an electric motor (1); a control unit (2); a thermal switch means (10) having a first and a second turn on condition and a turn off condition and another turn off condition of the electric motor (1); a timer (20), which measures the periods of time in the turn on and turn off conditions of the electric motor (1); a switch means (40), which selectively interrupts the energization of the electric motor (1), by instruction of the control unit (2); and a cycle counting means (30), which counts each first and second turn on conditions of the electric motor (1), the control unit (2) selectively activating the thermal switch means (10) to operate in determined turn on and turn off conditions of the electric motor (1). The timer (20) indicates to the control unit (2) a period of time of any of the first and second turn on conditions of the electric motor (1) which is equal to the respective predetermined maximum safety values.

9 Claims, 1 Drawing Sheet

SYSTEM AND A METHOD OF AUTOMATIC DEFROST FOR A REFRIGERATION APPLIANCE

FIELD OF THE INVENTION

The present invention refers to a system and a method of automatic defrost to be applied to refrigeration appliances, such as refrigerators and freezers.

BACKGROUND OF THE INVENTION

The refrigeration appliances of the natural convection type usually do not execute defrost automatically, requiring the user to promote the defrost operation manually, by turning off the refrigeration appliance (or only the compressor thereof) during the time necessary to melt all the ice accumulated on the evaporator.

The disadvantage of this system resides in the fact that the user has to turn off the refrigeration appliance manually.

In another construction of a refrigeration appliance, the thermostat of the latter is provided with a knob, for turning off the compressor, which will turn on again only when the temperature sensed by the sensing bulb of said thermostat reaches a predetermined temperature, sufficiently hot to melt the ice on the evaporator. This concept is used in most refrigeration appliances provided with a cabinet door. In this case, the user has to turn off the compressor every time a defrost operation of the evaporator is needed. Besides the disadvantage of requiring the user to initiate each defrost procedure, in this solution the refrigeration appliance loses almost all its function of promoting refrigeration during the defrost operation. The refrigeration appliances known as "cycle defrost" have another constructive variant for the defrost system. In these refrigeration appliances, the thermostat has a compressor turn on temperature, which remains fixed, regardless of the adjustment applied to the thermostat. Thus, every time the sensing bulb of the thermostat reaches a compressor turn off temperature, said compressor will turn on only when said sensing bulb detects said compressor turn on temperature. If this temperature is dimensioned to be positive and has a previously determined value, in order to allow the melting of the ice accumulated on the evaporator, the refrigeration appliance will promote defrost of the evaporator at each cycle of the compressor, whereby the user does not have to worry about executing this task.

Although this solution does not present the disadvantages of the previous solutions, it allows the occurrence of a great temperature variation over the food articles stored in the refrigeration appliance, which variation is much greater than in the previous cases, jeopardizing the preservation of said food articles.

Moreover, in load conditions or also in determined environmental conditions in the place where the refrigeration appliance is installed, the compressor may not turn off, and thereby will not promote the defrost operation. In these cases, after a certain time of refrigeration operation, there will be an excess of ice formed in the region of the evaporator that will act as a thermal insulator, impairing the refrigeration efficiency of the refrigeration appliance. On the other hand, in a normal operational condition of the refrigeration appliance, the defrost system of the latter will promote defrost at each cycle of the compressor, even when this operation is not required, causing unnecessary energy consumption, impairing the thermal recovery of the refrigeration order to count each first and second turn on conditions of the electric motor, the control unit selectively activating the thermal switch means to operate: a- in the first turn on condition and in the turn off condition, while the period of time in the first turn on condition is inferior to a respective predetermined maximum safety value and the number of cycles in the first turn on condition of the electric motor is inferior to a predetermined number; b- in the turn off condition and in the second turn on condition, when the predetermined number of cycles of the first turn on condition of the electric motor has been reached and until a subsequent second turn on condition has been reached; c- in the first turn on condition and in the turn off condition, after the second turn on condition has been reached, if the period of time in the second turn on condition is inferior to a respective predetermined maximum safety value, the control unit instructing the switch means to interrupt the energization of the electric motor when the timer indicates to the control unit a period of time of any of the first and second turn on conditions of the electric motor which is equal to the respective predetermined maximum safety values and maintaining said switch means condition until the occurrence of a subsequent second turn on condition of the electric motor, when the control unit instructs the switch means to allow the energization of the electric motor, the control unit activating the thermal switch means to operate with the other turn off condition, after the second turn on condition has been reached, if the period of time in one of the preceding turn off conditions and another turn off condition is equal or superior to a respective predetermined maximum defrost value, and to operate with the turn off condition and the first turn on condition, after the second turn on condition has been reached, if the period of time in the other preceding turn off condition is equal or inferior to a predetermined minimum defrost value.

BRIEF DESCRIPTION OF THE DRAWING

The invention will be described below, with reference to the attached drawing, in which.

BEST MODE OF CARRYING OUT THE PRESENT INVENTION

Figure 1:
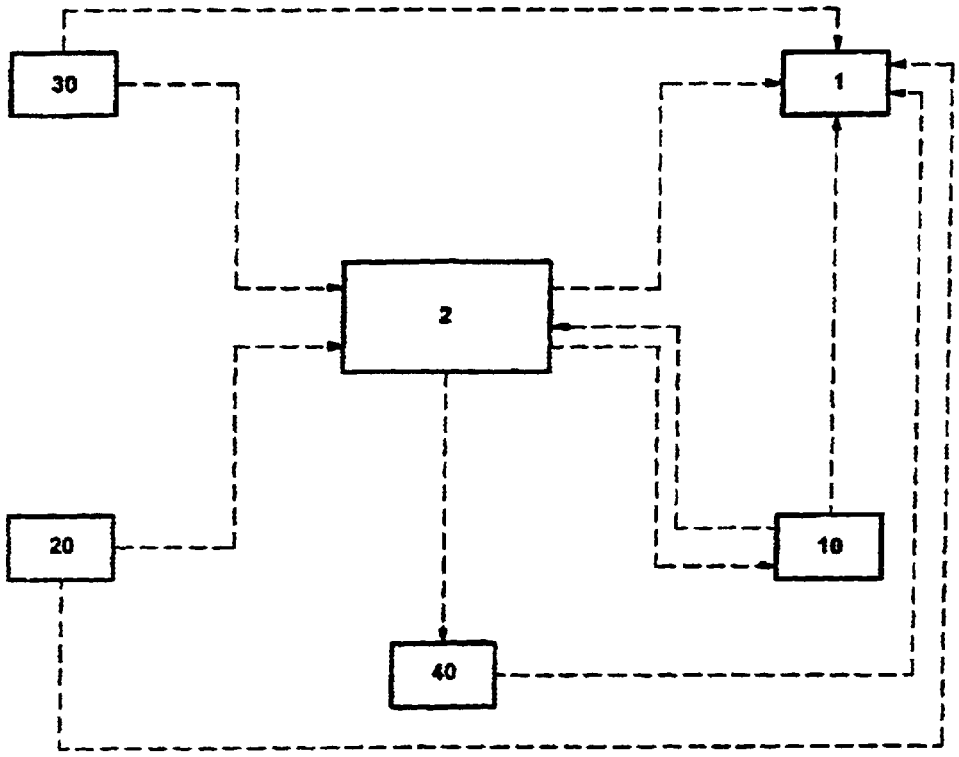
FIG. 1 illustrates, schematically and in a block diagram, the components of the system of the present invention and their operational connections.
Figure 2:
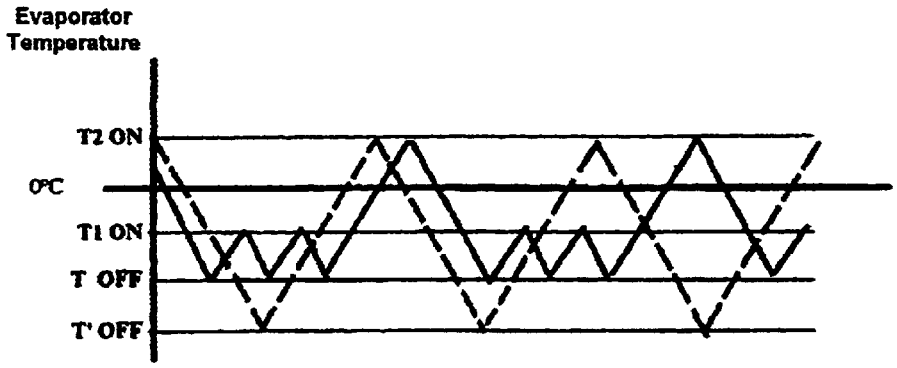
FIG. 2 illustrates, graphically, the temperature variation in a refrigeration appliance provided with the automatic defrost system of the present invention, for a normal operation (continuous line) and for an emergency defrost operation (dashed line) of said system.

According to the present invention, the automatic defrost system for a refrigeration appliance includes a hermetic compressor driven by an electric motor 1, which is operatively connected to both a control unit 2 and to a thermal switch means 10 comprising a plurality of temperature sensing means defined in order to detect determined temperatures in the refrigeration appliance and to inform said temperatures to the control unit 2.

According to the present invention, the automatic defrost system further comprises a timer 20, a cycle counting means 30 and a switch means 40, all to be described ahead and each being operatively connected to both the control unit 2 and the electric motor 1 of the compressor.

The control unit 2 is programmed to command a normal operational condition of refrigeration, in which it instructs the turn on and turn off of the electric motor 1 by a certain pre-established number of times, before instructing the beginning of a normal defrost regimen of this operational condition, and also to command an emergency defrost condition, when the timer 20 informs said control unit 2 about the occurrence of a turn on period of time, superior to a predetermined period of time, which represents an anomalous refrigeration condition of the refrigeration appliance.

According to the present invention, the thermal switch means 10 is operatively coupled to both the control unit 2 and the electric motor 1 and has: a first turn on condition, in which the electric motor 1 is activated and maintained operating at a first turn on temperature T1on; a second turn on condition, which activates the electric motor 1 at a second turn on temperature T2on higher than the first turn on temperature T1on; and a turn off condition, in which the electric motor 1 is turned off when a turn off temperature Toff has been reached.

The first turn on temperature T1on and the turn off temperature Toff are, for example, turn on and turn off limit temperatures of the electric motor 1, while the refrigeration appliance is in a refrigeration operation.

According to the figures, the first turn on temperature T1on and the turn off temperature Toff are negative temperatures, while the second turn on temperature T2on is a positive temperature, of defrost end.

During the normal operation of the refrigeration appliance, at each first turn on condition, the control unit 2 instructs the timer 20 to count the period of time in this condition, which value will be compared with a reference value by the control unit 2, so that the latter determines, as a function of the comparative result, whether to proceed or not with the current refrigeration operational regimen of the present system, and, with the period of time being at any of the first and second turn on conditions inferior to a respective predetermined maximum safety value and with the cycle counting means 20 indicating that the counted number of the first turn on conditions has reached a predetermined number, the control unit 2 instructs to turn off the electric motor 1 at the turn off condition subsequent to the turn on condition which has detected said predetermined number of counts of turn on conditions, and instructs the thermal switch means 10 to activate the second subsequent turn on temperature, indicating that the system has started a defrost regimen.

In the preferred solution, the control unit 2 instructs the timer 20 to measure the period of time between the beginning of the turn off condition and the subsequent second turn on condition, comparing said period of time with a respective reference period, in order to determine whether, after reaching said second turn on condition, the present system will return to the refrigeration regimen, or will operate again in a defrost regimen, as described below.

When said period of time is inferior to a predetermined maximum defrost value, the control unit 2 instructs the thermal switch means 10 to activate the turn off temperatures Toff and the first turn on temperature T1on, restarting the refrigeration operation.

In the illustrated construction, when the period of time between the turn off condition and the subsequent second turn on condition is equal or superior to the predetermined maximum defrost value, the control unit 2 instructs the thermal switch means 10 to operate in another turn off condition, which turns off the electric motor 1 at another turn off temperature T'off, which is lower than the turn off temperature Toff, maintaining the second turn on temperature T2on and the other turn off temperature T' off activated during the time in which the timer 20 detects a period of time of the preceding other turn off condition which is equal or inferior to a predetermined minimum defrost value which, when detected, makes the thermal switch means 10 operate again at the turn off temperatures and in the first turn on condition.

According to the present invention, when the period of time measured by the timer 20 between a preceding turn off condition and other turn off condition and a subsequent second turn on condition is equal or inferior to the predetermined minimum defrost value and the period of time between said second turn on condition and a subsequent turn off condition is inferior to the predetermined maximum safety value, the control unit 2 instructs the switch means 40 to operate between the first turn on condition and the turn off condition, also activating the cycle counting means 30 to count each first turn on condition, until one of the turn on conditions has reached the predetermined maximum safety value, or until the predetermined number of counts of the first turn on condition has been reached.

When the timer detects a period of time of any of the first and second turn on conditions which is equal to the respective predetermined maximum safety values, which are for example equal, the control unit 2 instructs the switch means 40 to interrupt the energization of the electric motor 1, maintaining this condition of the switch means 40 until the occurrence of a subsequent second turn on condition of the electric motor 1, when the control unit 2 instructs the energization of the electric motor 1.

This option of defrost operation by interrupting the energization of the electric motor 1 is adopted to avoid accumulation of the ice formed on the evaporator, due to a longer operational time of the hermetic compressor which is required, for example, by a greater demand of refrigeration from an ambient under refrigeration, said excess ice acting as a thermal insulator against the refrigeration, increasing energetic consumption, since it requires the compressor to work more, without however resulting in a better refrigeration.

In another constructive option, the present system further has a forced ventilation element 50, for example a fan, which is mounted to the refrigeration appliance in order to be activated by the control unit 2 when any of the turn off conditions and another turn off condition has been reached.

In the construction of the present invention, while the system is operating in a normal refrigeration and defrost regimen, the turn on and turn off limit temperatures of the electric motor 1 are constantly modified in the thermal switch 10 by instruction of the control unit 2. When the system starts the defrost operation in which the turn on and turn off limit temperatures are the second turn on temperature and the other turn off temperature, the system will operate with fixed temperatures, such as the conventional refrigeration appliances, said fixed temperatures being maintained until the thermal switch means 10 is instructed to operate in the normal refrigeration and defrost regimen.

What is claimed is:

1. An automatic defrost system for a refrigeration appliance, including a hermetic compressor driven by an electric motor (1) and a control unit (2), which is operatively connected to said electric motor (1), said system comprising:

a thermal switch means (10), which is operatively coupled to both the control unit (2) and the electric motor (10) and which has a first turn on condition, to activate the electric motor (1) at a first turn on temperature (T1on); a second turn on condition, to activate the electric motor (1) at a second turn on temperature (T2on) higher than the first turn on temperature (T1on); a turn off condition, to turn off the electric motor (1) at a turn off temperature; and another turn off condition with another turn off temperature lower than said turn off temperature;

a timer (20), which is operatively connected to both the control unit (2) and the electric motor (1), in order to measure the periods of time in the turn on and turn off conditions of the electric motor (1);

a switch means (40), which is operatively connected to both the control unit (2) and the electric motor (1), in order to interrupt the energization of the latter, by instruction of the control unit (2); and a cycle counting means (30), which is operatively connected to both the control unit (2) and the electric motor (1), in order to count each first and second turn on conditions of the electric motor (1), the control unit (2) selectively activating the thermal switch means (10) to operate: a- in the first turn on condition and in the turn off condition, while the period of time in the first turn on condition is inferior to a respective predetermined maximum safety value and the number of cycles in the first turn on condition of the electric motor (1) is inferior to a predetermined number; b- in the turn off condition and in the second turn on condition, when the predetermined number of cycles of the first turn on condition of the electric motor (1) has been reached and until a subsequent second turn on condition has been reached; c- in the first turn on condition and in the turn off condition, after the second turn on condition has been reached, if the period of time in the second turn on condition is inferior to a respective predetermined maximum safety value, the control unit instructing the switch means (40) to interrupt the energization of the electric motor (1) when the timer (20) indicates to the control unit (2) a period of time of any of the first and second turn on conditions of the electric motor (1) which is equal to the respective predetermined maximum safety values and maintaining said condition of the switch means (40) until the occurrence of a subsequent second turn on condition of the electric motor (1), when the control unit (2) instructs the switch means (40) to allow the energization of the electric motor (1), the control unit (2) activating the thermal switch means (10) to operate with the other turn off condition, after the second turn on condition has been reached, if the period of time in one of the preceding turn off conditions and another turn off condition is equal or superior to a respective predetermined maximum defrost value, and to operate with the turn off condition and the first turn on condition, after the second turn on condition has been reached, if the period of time in the other preceding turn off condition is equal or inferior to a predetermined minimum defrost value.

2. The system of claim 1, characterized in that the respective predetermined maximum safety values are equal.

3. The system of claim 2, characterized in that the control unit (2) activates a forced ventilation element (50), which is operatively associated with the refrigeration appliance, to operate during a certain predetermined time interval, after the second turn on condition has been reached.

4. The system of claim 3, characterized in that the control unit (2) maintains the forced ventilation element (50) in an operative condition while the second turn on condition is maintained.

5. The system of claim 1, characterized in that the other turn off temperature is defined in such a way as to result, together with the second turn on temperature, in an average temperature, substantially close to the average of the first turn on temperature with the turn off temperature.

6. The system of claim 5, characterized in that the second turn on temperature is positive.

7. A method of automatic defrost for a refrigeration appliance, including a hermetic compressor driven by an electric motor (1) and a control unit (2) operatively connected to the latter, characterized in that it comprises the steps of:

a- defining a first and a second turn on condition for activating the electric motor (1), respectively, at a first and a second turn on temperature higher than the first turn on temperature, and a turn off condition and another turn off condition, for turning off the electric motor (1), respectively, at a turn off temperature and another turn off temperature lower than the turn off temperature;

b- activating the electric motor (1) in the first turn on condition upon detecting the occurrence of a predetermined number of cycles corresponding to the number of occurrences of first turn on conditions which is lower than a predetermined number;

c- measuring the periods of time in the first and second turn on conditions and in the turn off condition and in the another turn off condition of the electric motor (1);

d- interrupting the energization of said electric motor (1) in any of the first and second turn on conditions, upon occurrence of one of the conditions: reaching the turn off temperature; being counted a number of occurrences of first turn on condition which is equal to the predetermined number; and the period of time in one of the first and second turn on conditions being equal to a respective predetermined maximum safety value; and e- instructing a thermal switch means (10) to operate in the other turn off condition when the period of time measured between one of the turn off conditions and another turn off condition and a subsequent second turn on condition is greater than a respective predetermined maximum defrost value, and instructing said thermal switch means (10) to operate in the turn off condition, when said period of time is inferior to a predetermined minimum defrost value.

8. The method of claim 7, characterized in that the maximum safety values are equal.

9. The method of claim 8, characterized in that it includes the additional step of: activating a forced ventilation element (50), which is operatively associated with the refrigeration appliance, to operate during a certain predetermined time interval, after one of the turn off conditions and another turn off condition has been reached.

* * * * *